US010122142B2

(12) United States Patent
Franke et al.

(10) Patent No.: US 10,122,142 B2
(45) Date of Patent: Nov. 6, 2018

(54) FLAT CABLE, SUBSTRATE THEREOF, AND METHOD OF MANUFACTURING AN ELECTRIC ASSEMBLY

(71) Applicants: Thomas Franke, Laupheim (DE); Michael Himmel, Ulm (DE)

(72) Inventors: Thomas Franke, Laupheim (DE); Michael Himmel, Ulm (DE)

(73) Assignee: E.SOLUTIONS GMBH (DE)

( * ) Notice: Subject to any disclaimer, the term of this patent is extended or adjusted under 35 U.S.C. 154(b) by 70 days.

(21) Appl. No.: 15/071,849

(22) Filed: Mar. 16, 2016

(65) Prior Publication Data

US 2016/0276767 A1 Sep. 22, 2016

(30) Foreign Application Priority Data

Mar. 20, 2015 (DE) ..... 10 2015 003 711

(51) Int. Cl.
*H01R 12/79* (2011.01)
*H01R 43/20* (2006.01)
*H01R 12/77* (2011.01)

(52) U.S. Cl.
CPC ..... *H01R 43/205* (2013.01); *H01R 12/77* (2013.01)

(58) Field of Classification Search
None
See application file for complete search history.

(56) References Cited

U.S. PATENT DOCUMENTS

2005/0041401 A1* 2/2005 Chuang ..... H05K 1/028 361/749
2009/0126976 A1 5/2009 Iida
2012/0087136 A1 4/2012 Kuwahara
2015/0022744 A1 1/2015 Tsai et al.

FOREIGN PATENT DOCUMENTS

DE 2014959 A1 11/1970
DE 2441665 A1 3/1976
DE 10 2004 053 958 B3 9/2005
DE 19819088 B4 6/2008
DE 10 2009 004 836 A1 7/2010

OTHER PUBLICATIONS

Summons to Attend Oral Proceedings for German Application No. 10 2015 003 711.0 dated Apr. 13, 2016.
Images found on www.lasertrader.de, retrieved from the Internet on Nov. 25, 2014. No translation available.

* cited by examiner

*Primary Examiner* — Dimary Lopez Cruz
(74) *Attorney, Agent, or Firm* — Tarolli, Sundheim, Covell & Tummino LLP

(57) ABSTRACT

A substrate for an electric flat cable is disclosed that includes an inner limb, having a first and a second portion spaced apart from each other along a longitudinal extent of the inner limb, at least one outer limb, having a first and a second portion spaced apart from each other along a longitudinal extent of the outer limb, and a connecting web, which extends so as to adjoin the first portions of the inner and the at least one outer limb. The inner limb extends at least substantially parallel to the outer limb, in a first direction. The second portion of the outer limb surrounds the second portion of the inner limb, at least partially, such that at least a cart of the second portion of the outer limb is disposed in the first direction in respect of the second portion of the inner limb.

12 Claims, 5 Drawing Sheets

FLAT CABLE, SUBSTRATE THEREOF, AND METHOD OF MANUFACTURING AN ELECTRIC ASSEMBLY

TECHNICAL FIELD

The present disclosure relates generally to the field of electric flat cables. It relates in particular to a substrate for an electric flat cable having a plurality of limbs in a plane of extent of the substrate. The disclosure additionally relates to an electric flat cable, an electric assembly and a method.

BACKGROUND

Electric flat cables are used for electrically connecting differing components to each other in the production of electric or electronic assemblies. Ribbon cables, for example, thus enable a multi-pole electric connection to be made by a single mechanical connecting operation. At the same time, ribbon cables have a high mechanical flexibility, thereby enabling electrically connected components to be moved or aligned in relation to each other. This favours, in particular, assembling of devices in which differing housing parts are fixedly connected to differing electric components of the device. In this case, ribbon cables enable the components that are fastened to individual housing parts to be first electrically connected to each other before the housing parts are finally joined together to form a closed housing.

In the field of electronics, a miniaturised form of ribbon cables, so-called flex printed circuit boards, is used for the purpose described. Flex printed circuit boards typically have a multiplicity of fine electric cores, which are imprinted onto a polyamide film. In order to increase the flexibility of such flex printed circuit boards and, at the same time, make it easier to control their position within an assembled device, the flex printed circuit boards are often pre-folded in the form of so-called U-, S- or Z-bends. If required, such a folded flex printed circuit board may be combined, for example in the manner of a stack, or folded out to form a greater length.

However, the use of pre-folded flex printed circuit boards in the assembling of electronic devices has several disadvantages. Thus, the folding of the flex printed circuit board means a high degree of loading for the material, which may possibly result in damage to the flex printed circuit board, and consequently in a functional failure. Moreover, in the case of folded flex printed circuit boards, reliable control of the final position of the flex printed circuit board cannot be ensured, either during or after the assembling of the corresponding device. Thus, during assembly, the flex printed circuit board may still be crushed in between housing parts, and a folded flex printed circuit board may also change its position in an uncontrolled manner in a device. Moreover, it is often not possible to unfold flex printed circuit boards fully in the region of their bends. This means an increased material requirement in order to achieve a longitudinal extent of the flex printed circuit board.

SUMMARY

The aim of the present disclosure is to rectify at least some of the above-mentioned or other disadvantages.

According to a first aspect, a substrate for an electric flat cable is described. The substrate comprises, in a plane of extent of the substrate, an inner limb, having a first and a second portion that are spaced apart from each other along a longitudinal extent of the inner limb, at least one outer limb, having a first and a second portion that are spaced apart from each other along a longitudinal extent of the outer limb, and a connecting web, which extends so as to adjoin and connect the first portions of the inner and the at least one outer limb. The inner limb in this case, starting from the connecting web and within the plane of extent of the substrate, extends at least substantially parallel to the outer limb, in a first direction, and the second portion of the outer limb surrounds the second portion of the inner limb, at least partially, such that at least a part of the second portion of the outer limb is disposed in the first direction in respect of the second portion of the inner limb.

The second portion of the inner limb may comprise a free end of the inner limb. The second portion of the outer limb in this case may surround the second portion of the inner limb, such that the part of the second portion of the outer limb that is disposed in the first direction in respect of the second portion of the inner limb is opposite the free end of the inner limb.

The substrate may be at least largely rigid in respect of a deformation within the plane of extent. In addition or as alternative to this, the substrate may be at least largely flexible in respect of a relative alignment of the limbs in a second direction, which is perpendicular to the plane of extent of the substrate. The inner limb and/or the outer limb may be elastically flexible in the second direction. In addition or as an alternative to this, the substrate may have regions that are at least largely rigid in respect of a deformation in the second direction. The substrate in this case may be at least largely rigid, in the region of the connecting web, in the region of the second portion of the inner limb and/or in the region of the second portion of the outer limb, in respect of a deformation in the second direction. In addition or as an alternative to this, the substrate may have at least one hinge in the region of the inner limb and/or in the region of the outer limb.

The substrate may comprise two outer limbs. The outer limbs in this case may be disposed on opposite sides of the inner limb. In addition or as an alternative to this, the outer limbs may be connected to each other in the region of their second portions.

The substrate may comprise flexible plastic. For example, the substrate may comprise polyamide. The substrate may be provided to accommodate electric terminals (e.g. in the form of plug contacts) and electric conductors for connecting the terminals, and thus form an electric flat cable.

According to a second aspect, an electric flat cable is described. The electric flat cable comprises, in a plane of extent of the flat cable, an inner limb, having a first and a second portion that are spaced apart from each other along a longitudinal extent of the inner limb, at least one outer limb, having a first and a second portion that are spaced apart from each other along a longitudinal extent of the outer limb, and a connecting web, which extends so as to adjoin and connect the first portions of the inner and the at least one outer limb. The inner limb in this case, starting from the connecting web and within the plane of extent of the flat cable, extends at least substantially parallel to the outer limb, in a first direction, and the second portion of the outer limb surrounds the second portion of the inner limb, at least partially, such that at least a part of the second portion of the outer limb is disposed in the first direction in respect of the second portion of the inner limb.

The electric flat cable may comprise a substrate of the type presented here. In addition, the flat cable may comprise electric components, such as terminals and conductors.

The electric flat cable may comprise at least one first electric terminal, which is disposed in the region of the second portion of the inner limb. Further, the electric flat cable may comprise at least one second electric terminal, which is disposed in the region of the second portion of the outer limb. The electric flat cable in this case may additionally comprise at least one electric core, which electrically connects the first and the second terminal to each other.

The flat cable may comprise two outer limbs. The two outer limbs may be connected to each other in the region of their second portions. In addition or as an alternative to this, the flat cable may comprise at least two first terminals, at least two second terminals, and at least two cores, which each electrically connect one of the first and one of the second terminals to each other. In this case, at least one second electric terminal may be disposed in the region of the second portion of each outer limb. As an alternative to this, all second electric terminals may be disposed in the region of the second portion of the same outer limb.

At least one of the terminals may be a part of an electric plug connection. For example, each terminal may be part of one or more electric plug connections.

All cores may extend along the same outer limb. In addition or as an alternative to this, at least one core may extend along each outer limb. In this case, an at least approximately equal number of cores may extend along each outer limb.

According to a third aspect, a further electric flat cable is described. The electric flat cable comprises, in a plane of extent of the flat cable, at least one inner limb, having a first and a second portion that are spaced apart from each other along a longitudinal extent of the inner limb, at least two outer limbs, which are disposed on opposite sides of the inner limb and which each have a first and a second portion that are spaced apart from each other along a longitudinal extent of the respective limb, and a connecting web, which extends so as to adjoin and connect the first portions of the inner and the outer limb. The electric flat cable additionally comprises at least two electric terminals, of which at least one is disposed in the region of the second portion of the inner limb and at least one further is disposed in the region of the second portion of at least one of the outer limbs, and at least one electric core, which electrically connects the terminal in the region of the second portion of the inner limb and the terminal in the region of the second portion of the outer limb to each other. The inner and the outer limb, starting from the connecting web and within the plane of extent of the flat cable, extend at least substantially parallel to each other.

According to a fourth aspect, an electric assembly is described. The electric assembly comprises at least two electric components, and at least one electric flat cable of the type presented here, which electrically connects the components to each other.

The components may be movable relative to each other in a second direction, which is perpendicular to the plane of extent of the flat cable. For example, the components may be movable relative to each other in the second direction at least in the region of the second portions of the limbs of the flat cable. The components in this case may be pivotally connected to each other. In addition or as an alternative to this, the components may be able to be fixed in respect of a movement relative to each other in the second direction. The components in this case may be able to be fixed by means of a screwed connection and/or a snap connection.

The electric assembly may be a mobile terminal device. The mobile terminal device may be a smartphone or a tablet PC.

According to a fifth aspect, a method for producing an electric assembly is described. The method comprises providing a first and a second electric component, and providing an electric flat cable that, in a plane of extent of the flat cable, comprises an inner limb, having a first and a second portion that are spaced apart from each other along a longitudinal extent of the inner limb, at least one outer limb, having a first and a second portion that are spaced apart from each other along a longitudinal extent of the outer limb, and a connecting web, which extends so as to adjoin and connect the first portions of the inner and the at least one outer limb, the inner limb, starting from the connecting web and within the plane of extent of the flat cable, extending at least substantially parallel to the outer limb, in a first direction, and the second portion of the outer limb surrounding the second portion of the inner limb, at least partially, such that at least a part of the second portion of the outer limb is disposed in the first direction in respect of the second portion of the inner limb. The method additionally comprises electrically connecting the second portion of the inner limb or of the outer limb to the first component, and electrically connecting the second portion of the respectively other of the inner and the outer limb to the second component. The method additionally comprises moving the first and the second component relative to each other in a second direction, which is perpendicular to the plane of extent of the substrate, such that a distance between the first and the second component in the region of the second portions of the limbs is reduced, and fixing the components in respect of a movement relative to each other in the second direction.

BRIEF DESCRIPTION OF THE DRAWINGS

Further features and advantages of the present disclosure become clear from the detailed description and from the accompanying drawings. There are shown in.

DETAILED DESCRIPTION

Figure 1:
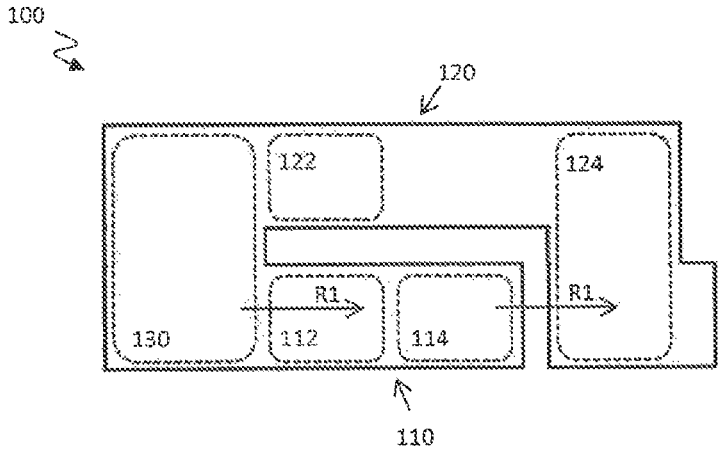
FIG. 1 a schematic representation of an exemplary embodiment for a substrate for an electric flat cable according to the present disclosure.

FIG. 1 shows a schematic representation of an exemplary embodiment for a substrate 100 for an electric flat cable. The substrate 100 has an inner limb 110 and an outer limb 120, which are connected to each other via a connecting web 130. The inner and the outer limb 110, 120 each have a first portion 112, 122 and a second portion 114, 124 that are spaced apart from each other along a direction of extent of the corresponding limb 110, 120.

The inner and the outer limb 110, 120 adjoin the connecting web 130 via their first portion 112, 122, respectively. In addition, the inner and the outer limb 110, 120, starting from the connecting web 130, extend parallel to each other in a first direction R1 over the length of the inner limb 110. In addition, the outer limb 120 projects around the inner limb 110 in such a manner that the outer limb 120 surrounds the free end of the inner limb in the region of the second portion 114 thereof, such that a part of the second portion 124 of the outer limb 120 is opposite the second portion 114 of the inner limb 110 in the first direction R1.

In the case of the substrate 100 represented, the boundary region between the connecting web 130 and the first portion 112 of the inner limb 110 and the second portion 114 of the inner limb 110 and the part of the second portion 124 of the outer limb 120 that is opposite the second portion 114 of the inner limb 110 are aligned such that they lie along the same axis. As described above, for this purpose in the example represented the inner limb 110 and the outer limb 120 extend parallel to each over the length of the inner limb 110. In alternative examples, however, the described alignment between the connecting region of the inner limb 110, the second portion 114 of the inner limb 110 and the opposing part of the second portion 124 of the outer limb 120 may also be achieved by a design of the limbs 110, 120 that is other than an exactly parallel course, for example a slightly curved design.

The substrate 100, in its plane of extent, has a relatively high rigidity in respect of possible deformations in the plane of extent. At the same time, the inner limb 110 and the outer limb 120 are flexible relative to each other in a direction perpendicular to the plane of extent of the substrate 100. For this purpose, the substrate 100 is made, for example, of flexible plastic such as, for instance, polyamide, or of synthetic resin.

The substrate 100 is provided as a substrate for an electric flat cable. The substrate 100 in this case is designed to be provided with electric terminals in the region of the second portions 114, 124 of the inner 110 and of the outer limb 120, and with electric conductors along the inner and the outer limb 110, 120 and along the connecting web 130, the conductors connecting the electric terminals in the two portions 114, 124 of the two limbs 110, 120 to each other. For example, the substrate 100 may be designed to accommodate electric plug connectors in the region of the second portions 114, 124 of the inner and the outer limb 110, 120, between which there may be applied, along the surface of the substrate 100, electric cores that connect the electric terminals to each other.

In the case of the substrate being fastened to differing electric components in the region of the second portions 114, 124 of the inner and the outer limb 110, 120, the described nature of the substrate 100 enables the components, connected in such a manner, to be disposed rigidly in relation to each other in the plane of extent of the substrate 100. At the same time, the flexibility of the limbs perpendicularly to the plane of extent allows the connected components to move relative to each other in this second direction.

Figure 2A:
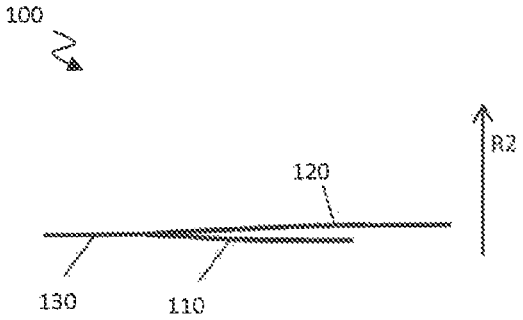
FIGS. 2*a* and 2*b* schematic representations of differing positions of a substrate for an electric flat cable according to the present disclosure.

FIG. 2*a* shows a schematic view of the substrate 100 from FIG. 1, in a side view in the plane of extent of the substrate 100. For the purpose of illustration in this case, the inner limb 110 and the outer limb 120 are represented with a slight offset relative to each other in the second direction R2, which is perpendicular to the plane of extent of the substrate 100. However, FIG. 2*a* in this case shows the substrate 100 with a virtually coplanar alignment of the limbs 110, 120 in the plane of extent.

Figure 2B:
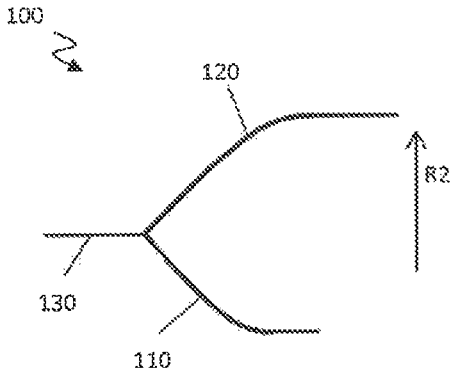

FIG. 2*b* shows a schematic representation of the substrate 100 from FIG. 2*a*, likewise in a side view of the plane of extent of the substrate 100. Unlike the example from FIG. 2*a*, however, in FIG. 2*b* the limbs 110, 120 of the substrate 100 have a large deflection in the second direction R2 relative to each other.

A comparison of FIGS. 2*a* and 2*b* shows that, even in the case of a large deflection of the limbs 110, 120, the connecting web 130 does not undergo any substantial change in its alignment as compared with its position in FIG. 2*a*. In particular, even in the case of a large deflection of the limbs 110, 120 in relation to each other, the connecting web 130 undergoes virtually no tilting. Similarly, in the case of a transition between the positions shown in FIGS. 2*a* and 2*b*, the substrate 100 in its totality also undergoes virtually no lateral tilting or torsion. The determining factor in this is the axial alignment of the connecting region between the inner limb 110 and the connecting web 130, described in connection with FIG. 1, and the regions of the second portions 114, 124 of the limbs that are provided in each case for fastening the limbs 110, 120. Besides the rigidity of the substrate 100 in respect of deformations in its plane of extent, the described geometry of the substrate 100 additionally makes it possible to avoid, to a large extent, the occurrence of tilting forces on parts of the substrate 100.

In the example of FIG. 2*b*, even with the limbs 110, 120 bent to a large extent, the ends of the inner and the outer limb 110, 120 are represented without curvature in the region of which fastening of the substrate 100 to differing electric components (e.g. printed circuit boards) is provided. In the example shown, these regions of the limbs 110, 120 may be realized, for example, as rigid regions. Such rigid regions of the substrate 100 may be provided for accommodating further electric components or circuits.

Figure 3:
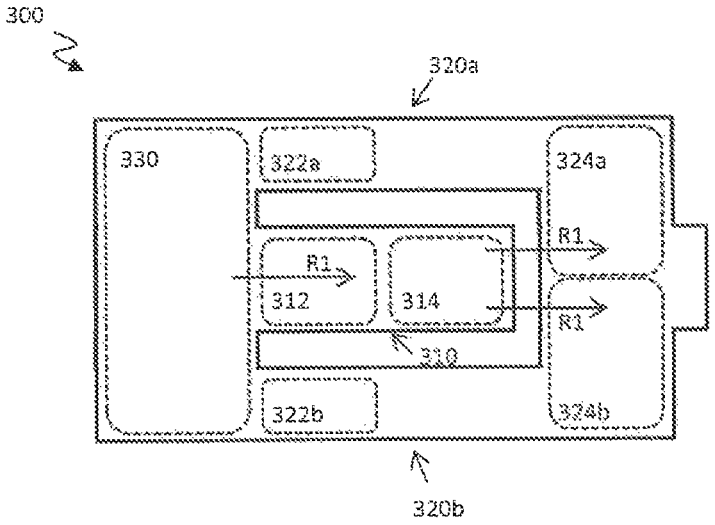
FIG. 3 a schematic representation of a further exemplary embodiment for a substrate for an electric flat cable according to the present disclosure.

FIG. 3 shows a schematic view of a further exemplary embodiment for a substrate 300 for an electric flat cable. In a manner similar to the example from FIG. 1, the substrate 300 from FIG. 3 has an inner limb 310, having a first portion 312 and a second portion 314, the inner limb 310 being connected, via the connecting web 330, to the outer limb 320*a*, which in turn has a first portion 322*a* and a second portion 324*a*. In addition, in a manner similar to the example from FIG. 1, the outer limb 320*a* of the substrate 300 is realized such that a part of the second portion 324*a* of the outer limb 320*a* partially projects around the free end of the inner limb 310 such that this part is opposite the free end of the inner limb 310 in the direction of extent R1 of the inner limb 310.

Unlike the example from FIG. 1, however, the substrate 300 from FIG. 3 additionally has a second outer limb 320*b*, which likewise comprises a first portion 322*b* and a second portion 324*b*. In the example shown, the two outer limbs 320*a*, 320*b* are disposed symmetrically on opposite sides of the inner limb 310. In addition, the outer limbs 320*a*, 320*b* are connected to each other in the region of their second portions 324*a*, 324*b*.

The statements made in connection with the substrate 100 from FIGS. 1, 2*a* and 2*b* apply accordingly to the substrate 300. In the case of the use described in connection with FIGS. 1, 2*a* and 2*b*, however, the substrate 300 has the advantage, in comparison with the substrate 100 from FIG.

1, that, with the outer limbs 320*a*, 320*b* appropriately fastened in the region of their second portions 324*a*, 324*b*, the symmetrical design along the axis of extent of the inner limb 310 helps further to reduce the occurrence of tilting forces on parts of the substrate 300.

Figure 4:
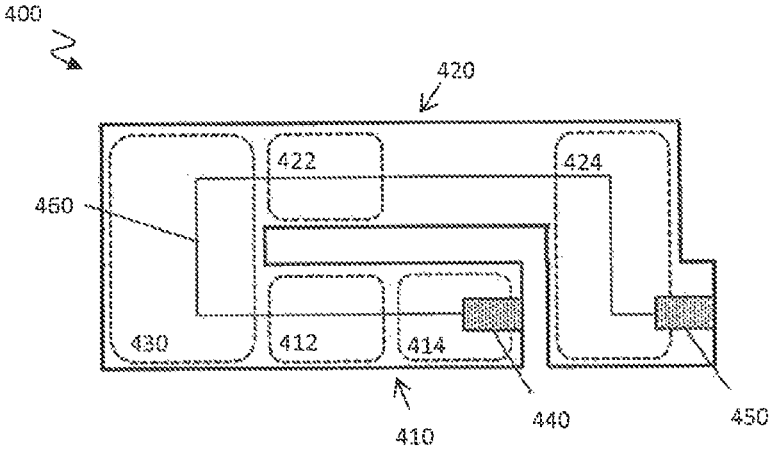
FIG. 4 a schematic representation of an exemplary embodiment for an electric flat cable according to the present disclosure.

FIG. 4 shows a schematic representation of an exemplary embodiment for an electric flat cable 400. In a manner similar to the substrate 100 from FIG. 1, the electric flat cable from FIG. 4 has an inner limb 410 and an outer limb 420, which adjoin a connecting web 430 of the electric flat cable 400 in the region of a first portion 412, 422, respectively, and are connected by this connecting web. In addition, each of the limbs 410, 420 of the electric flat cable 400 has a second portion 414, 424, the outer limb 422 partially surrounding the inner limb 410 in the region of the second portion 424. Unlike the substrate 100 from FIG. 1, however, the electric flat cable 400 additionally has a first electric terminal 440 in the region of the second portion 414 of the inner limb 410, and a second electric terminal 450 in the region of the second portion 424 of the outer limb 420, which terminals are connected by means of an electric core 460. The electric core 460 in this case extends along the limbs 410, 420 and the connecting web 460.

The statements made in connection with FIGS. 1, 2*a* and 2*b* apply accordingly to the geometric design of the electric flat cable 400 and the mechanical properties thereof. In particular, in one example, the electric flat cable 400 comprises a substrate, of the type described in connection with FIG. 1, that is provided with the first electric terminal 440, the second electric terminal 450 and the electric core 460. In different examples, however, the electric flat cable 400 may also be realized without the use of a substrate. Moreover, in other examples, there may be a plurality of terminals 440 and a plurality of second terminals 450, which are respectively connected to each other by means of a plurality of electric cores 460. In some examples, the electric terminals 440, 450 are additionally realized as electric plug connectors. Besides an electrical connection, it is thereby possible to achieve at the same time a mechanical connection of the limbs 410, 420, in the region of their second portions 414, 424, respectively, by means of the thus connected electric components.

Figure 5:
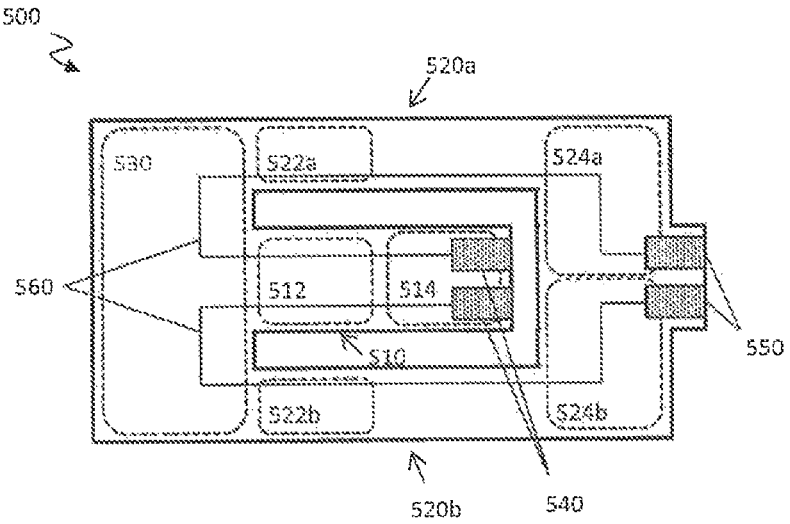
FIG. 5 a schematic representation of a further exemplary embodiment for an electric flat cable according to the present disclosure.

FIG. 5 shows a schematic view of a further exemplary embodiment for an electric flat cable 500. Like the electric flat cable 400 from FIG. 4, the electric flat cable 500 from FIG. 5 also has an inner limb 510, having a first portion 512 and a second portion 514, and an outer limb 520*a*, likewise having a first portion 522*a* and a second portion 524*a*, which limbs adjoin a connecting web 530 in the region of their first portions 512, 522*a*, respectively, and are connected to each other via this connecting web. Further, in the case of the electric flat cable 500, also, the outer limb, in the region of its second portion 524*a*, surrounds the free end of the inner limb 510 in such a manner that a part of the second portion 524*a* of the outer limb 520*a* is opposite the second portion 514 of the inner limb 510 in the direction of extent of the inner limb 510. Moreover, the electric flat cable 500 also has first and second terminals 540, 550, which are connected to each other by means of electric cores 560.

Unlike the electric flat cable 400 from FIG. 4, however, the electric flat cable 500 from FIG. 5, in a manner similar to the substrate 300 from FIG. 3, has a second outer limb 520*b*, having a first portion 522*b* and a second portion 524*b*, the two outer limbs 520*a*, 520*b* being disposed symmetrically on opposite sides of the inner limb 510. In respect of the geometry of the electric flat cable 500, therefore, the statements made in connection with the substrate 300 from FIG. 3 apply accordingly. In particular, in one example, the flat cable 500 from FIG. 5 comprises a substrate of the type described in connection with FIG. 3. Furthermore, the statements made in connection with the electric flat cable 400 from FIG. 4 also apply accordingly to the electric flat cable from FIG. 5.

The electric flat cable 500 comprises, in the second portion 514 of the inner limb 510, two first electric terminals 540, which are connected to a second electric terminal 550 by means of respectively one of the electric cores 560. The two second electric terminals in this case are disposed, respectively, in the region of the second portion 524*a*, 524*b* of differing outer limbs 520*a*, 520*b*. Further, in the example shown, each of the electric cores 560 extends along that outer limb 520*a*, 520*b* in whose second portion 524*a*, 524*b* is disposed that second electric terminal 550 to which the core is connected. In alternative designs, however, all second electric terminals 550 may be disposed in the second region 524*a*, 524*b* of only one outer limb 520*a*, 520*b*. Irrespective of this, in further examples all cores 560 may extend along only one of the outer limbs 520*a*, 520*b*.

Figure 6:
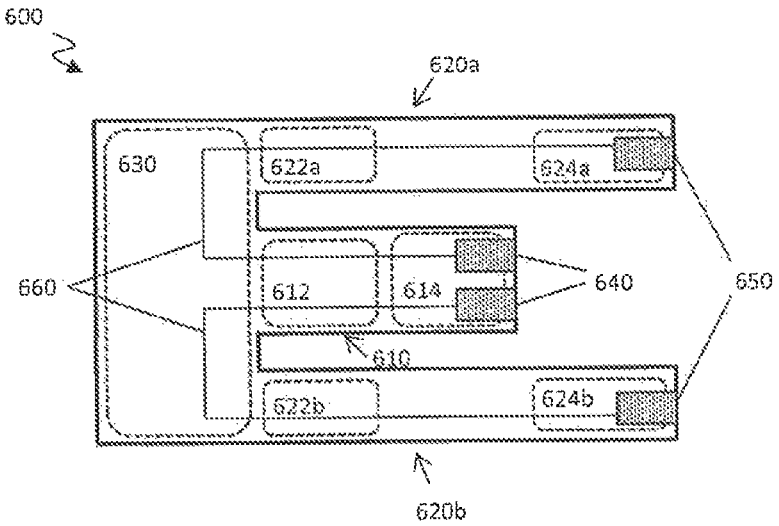
FIG. 6 a schematic representation of another exemplary embodiment for an electric flat cable according to the present disclosure.

FIG. 6 shows a schematic representation of a further exemplary embodiment for an electric flat cable 600. In a manner similar to the electric flat cable 500 from FIG. 5, the electric flat cable 600 from FIG. 6 also has an inner limb 610, as well as outer limbs 620*a*, 620*b*, which are disposed on opposite sides of the inner limb 610 and which adjoin a connecting web 630 in the region of a first portion 612, 622*a*, 622*b*, respectively, and are connected to each other via this connecting web. Further, in the case of the electric flat cable 600, also, each limb 610, 620*a*, 620*b* has a second portion 614, 624*a*, 624*b*, first electric terminals 640 being disposed in the second portion 614 of the inner limb 610, and second electric terminals 650 being disposed in the second portions 624*a*, 624*b* of the outer limbs 620*a*, 620*b*, which terminals are interconnected by means of electric cores 660.

Unlike the electric flat cable 500 from FIG. 5, however, in the case of the electric flat cable 600 from FIG. 6 the second portions 624*a*, 624*b* of the outer limbs 620*a*, 620*b* are not connected to each other. The manner of functioning described in connection with the electric flat cable 500 from FIG. 5 and the substrate 300 from FIG. 3 can also be achieved by the electric flat cable 600 from FIG. 6, however, if both outer limbs 620*a*, 620*b* are connected to the same electric component, and this electric component has a sufficient mechanical rigidity suitable for replacing a corresponding connection of the outer limb portions 624*a*, 624*b* as part of the flat cable.

Figure 7:
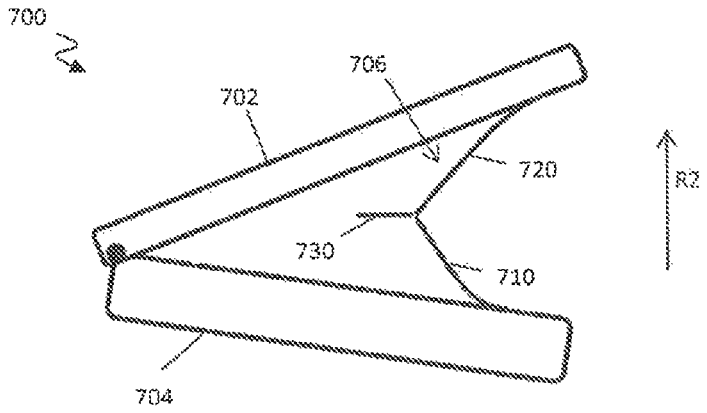
FIG. 7 a schematic representation of an exemplary embodiment for an electric assembly according to the present disclosure.

FIG. 7 shows a schematic representation of an exemplary embodiment for an electric assembly 700. The electric assembly 700 comprises two electric components 702, 704, as well as an electric flat cable 706 of the type described here, which electrically connects the components 702, 704 to each other. In particular, the electric flat cable 706 likewise comprises an inner limb 710 and at least one outer limb 720, which are connected to each other via a connecting web 730.

In the example of FIG. 7, the components 702, 704 of the assembly 700 are pivotally connected to each other in an edge region. The components 702, 704 in this case can be pivoted in such a manner that they can be moved relative to each other, in the second direction R2, in the region of the electric flat cable 706. FIG. 7 in this case shows the electric assembly 700 in a position in which the components 702, 704 have been pivoted in relation to each other in such a manner that the limbs 710, 720 of the electric flat cable 706 have been bent out of the plane of extent of the flat cable 706. In other examples, the components 702, 704 may be connected to each other solely by the flat cable 706.

The electric assembly 700 is, for example, an electrical or electronic device, the components 702, 704 each comprising housing parts of the assembly 700. Fastened to the housing parts are electric components (e.g. printed circuit boards), which are connected to each other by means of the electric flat cable 706. Moreover, in some examples, the components 702, 704 are intended to be joined together in such a manner that this results in a closed housing of the assembly 700. In this case, when the components 702, 704 are in an open pivot position as shown in FIG. 7, the electric flat cable 706 enables the limbs 710, 720 each to be connected to one of the components 702, 704, and the components subsequently to be moved towards each other such that they are joined together, forming a closed housing. The components 702, 704 in this case may be, for example, fixed in a reversible manner in the closed position.

In the case of the described use of an electric flat cable 706 of the type presented here, such a flat cable allows convenient assembling of the components, by prior electrical connection and subsequent mechanical alignment of the connected components. Unlike conventional flat cables in this case, owing to the relative rigidity of the flat cable in respect of a deformation within its plane of extent, a position of the electric flat cable 706 can be easily controlled at any time in the assembling process, and is also stable against warping when in the assembled state. Moreover, depending on the specific application and assembly requirements, the electric flat cable 706 is also easily configured in respect of its dimensions and conductor properties. In addition, as compared with conventional solutions, the electric flat cable 706 can be mounted with a comparatively large opening angle of the housing parts 702, 704, which simplifies assembly.

Figure 8:
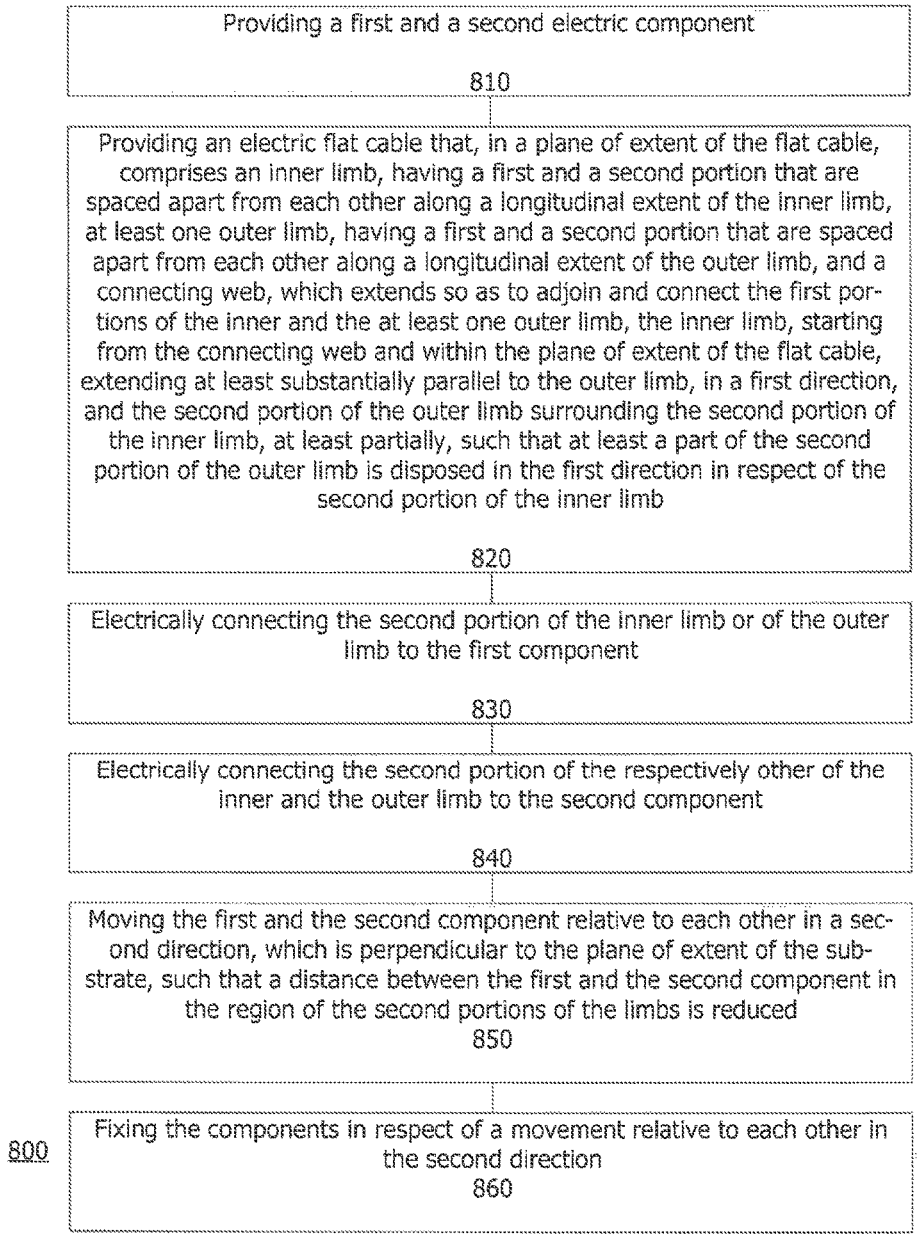
FIG. 8 a sequence diagram of an exemplary embodiment for a method for producing an electric assembly according to the present disclosure.

FIG. 8 shows a sequence diagram of an exemplary embodiment for a method 800 for producing an electric assembly, as described in connection with FIG. 7. The method 800 comprises, in a first step 810, providing a first and a second electric component. Further, the method 800 comprises providing an electric flat cable that, in a plane of extent of the flat cable, comprises an inner limb, having a first and a second portion that are spaced apart from each other along a longitudinal extent of the inner limb, at least one outer limb, having a first and a second portion that are spaced apart from each other along a longitudinal extent of the outer limb, and a connecting web, which extends so as to adjoin and connect the first portions of the inner and the at least one outer limb. The inner limb in this case, starting from the connecting web and within the plane of extent of the flat cable, extends at least substantially parallel to the outer limb, in a first direction. In addition, the second portion of the outer limb surrounds the second portion of the inner limb, at least partially, such that at least a part of the second portion of the outer limb is disposed in the first direction in respect of the second portion of the inner limb, step 820.

The method 800 additionally comprises electrically connecting the second portion of the inner limb or of the outer limb to the first component, step 830. The limb in this case is, for example, the limb 720 of the electric flat cable 706 from FIG. 7, which is connected to the component 702 of the assembly 700. The method 800 then comprises electrically connecting the second portion of the respectively other of the inner and the outer limb to the second component, step 840. For example, this is connecting the limb 710 of the electric flat cable 706 from FIG. 7 to the component 704.

The method 800 then provides for moving the first and the second component relative to each other in a second direction, which is perpendicular to the plane of extent of the substrate, such that a distance between the first and the second component in the region of the second portions of the limbs is reduced, step 850. Such moving of the components consists, for example, in pivoting the components 702, 704 from FIG. 7 about their connection point, such that the components 702, 704 are moved towards each other in the region of the electric flat cable 706.

The method 800 additionally comprises fixing the components in respect of a movement relative to each other in the second direction, step 860. Such fixing corresponds, for example, to screw-connecting the components 702, 704 joined together to form a closed housing, to complete the assembling of the assembly 700.

The invention claimed is:

1. An electric assembly comprising:

at least two electric components; and at least one electric flat cable, which electrically connects the components to each other, the electric flat cable comprising, in a plane of extent of the flat cable:

an inner limb, having a first and a second portion that are spaced apart from each other along a longitudinal extent of the inner limb;

at least one outer limb, having a first and a second portion that are spaced apart from each other along a longitudinal extent of the outer limb;

a connecting web, which extends so as to adjoin and connect the first portions of the inner and the at least one outer limb;

at least one first electric terminal, which is disposed in the region of the second portion of the inner limb and which is connected to a first one of the at least two electric components;

at least one second electric terminal, which is disposed in the region of the second portion of the outer limb and which is connected to a second one of the at least two electric components; and at least one electric core, which electrically connects the first and the second terminal to each other, the inner limb, starting from the connecting web and within the plane of extent of the flat cable, extending at least substantially parallel to the outer limb, in a first direction, and the second portion of the outer limb surrounding the second portion of the inner limb, at least partially, such that at least a part of the second portion of the outer limb is disposed in the first direction in respect of the second portion of the inner limb, wherein the electric flat cable has a relatively high rigidity in respect of a deformation within the plane of extent and a relatively low rigidity in respect of a relative alignment of the limbs in a second direction, which is perpendicular to the plane of extent of the flat cable, and at least one of the inner limb and the outer limb is elastically flexible in the second direction, wherein the electric components are movable relative to each other in the second direction between a first relative position and a second relative position, wherein, in the second relative position of the electric components, each of the at least one first electric terminal connected to the respective electric component is spaced apart further from each of the at least one second electric terminal connected to the respective electric component than in the first relative position, wherein, in the first relative position of the electric components, each of the at least one first electric terminal and each of the at least one second electric terminal substantially extend in the first direction, and wherein, in the second relative position of the electric components, the connecting web is substantially arranged, in the second direction, between the at least one first electric terminal and the at least one second electric terminal.

2. The electric assembly according to claim 1, wherein the flat cable comprises two outer limbs, which are connected to each other in the region of their second portions.

3. The electric assembly according to claim 2, wherein the flat cable comprises at least two first terminals, at least two second terminals, and at least two cores, which each electrically connect one of the first and one of the second terminals to each other, and at least one second electric terminal being disposed in the region of the second portion of each outer limb.

4. The electric assembly according to claim 1, wherein at least one of the terminals is a part of an electric plug connection.

5. The electric assembly according to claim 1, wherein each of the at least one electric cores extend along the same outer limb.

6. The electric assembly according to claim 1, wherein at least one core extends along each outer limb.

7. The electric assembly according to claim 1, wherein the electric components are able to be fixed in respect of a movement relative to each other in the second direction.

8. The electric assembly according to claim 1, wherein the electric assembly is a mobile terminal device.

9. The electric assembly according to claim 1, wherein the second portion of the inner limb comprises a free end of the inner limb, and the second portion of the outer limb surrounding the second portion of the inner limb, such that the part of the second portion of the outer limb that is disposed in the first direction in respect of the second portion of the inner limb is opposite the free end of the inner limb.

10. The electric assembly according to claim 1, comprising flexible plastic.

11. An electric assembly comprising:

at least two electric components; and at least one electric flat cable, which electrically connects the components to each other, the electric flat cable comprising, in a plane of extent of the flat cable:

at least one inner limb, having a first and a second portion that are spaced apart from each other along a longitudinal extent of the inner limb;

at least two outer limbs, which are disposed on opposite sides of the inner limb and which each have a first and a second portion that are spaced apart from each other along a longitudinal extent of the respective limb;

a connecting web, which extends so as to adjoin and connect the first portions of the inner and the outer limb;

at least two electric terminals, wherein at least one first electric terminal of the electric terminals is disposed in the region of the second portion of the inner limb and is connected to a first one of the at least two electric components, and at least a second one of the electric terminals is disposed in the region of the second portion of at least one of the outer limbs and is connected to a second one of the at least two electric components; and at least one electric core, which electrically connects the terminal in the region of the second portion of the inner limb and the terminal in the region of the second portion of the outer limb to each other, the inner and the outer limb, starting from the connecting web and within the plane of extent of the flat cable, extending at least substantially parallel to each other in a first direction, wherein the electric flat cable has a relatively high rigidity in respect of a deformation within the plane of extent and a relatively low rigidity in respect of a relative alignment of the limbs in a second direction, which is perpendicular to the plane of extent of the flat cable, and at least one of the inner limb and the outer limb is elastically flexible in the second direction, wherein the electric components are movable relative to each other in the second direction between a first relative position and a second relative position, wherein, in the second relative position of the electric components, each of the at least one first electric terminal connected to the respective electric components is spaced apart further from each of the at least one second electric terminal connected to the respective electric components than in the first relative position, wherein, in the first relative position of the electric components, each of the at least one first electric terminal and each of the at least one second electric terminal substantially extend in the first direction, and wherein, in the second relative position of the electric components, the connecting web is substantially arranged, in the second direction, between the at least one first electric terminal and the at least one second electric terminal.

12. The electric assembly according to claim 11, wherein the electric components are able to be fixed in respect of a movement relative to each other in the second direction.

* * * * *